US005196639A

United States Patent [19]

Lee et al.

[11] Patent Number: 5,196,639

[45] Date of Patent: Mar. 23, 1993

[54] METHOD AND APPARATUS FOR PRODUCING AN ELECTRONIC REPRESENTATION OF A MUSICAL SOUND USING COERCED HARMONICS

[75] Inventors: J. Robert Lee; David T. Starkey, both of San Diego, Calif.

[73] Assignee: Gulbransen, Inc., Las Vegas, Nev.

[21] Appl. No.: 633,475

[22] Filed: Dec. 20, 1990

[51] Int. Cl.[5] ..... G10H 17/00; G10L 9/14

[52] U.S. Cl. ..... 84/603; 84/601; 84/604; 84/608

[58] Field of Search ..... 84/622, 625, 648, 601, 84/603, 604, 605, 606, 607, 608, 615, 616, 621, 623, 627, 696, 698, 675, 681

[56] References Cited

U.S. PATENT DOCUMENTS

| | | | |
|---|---|---|---|
| 3,809,786 | 5/1974 | Deutsch . | |
| 4,231,277 | 11/1980 | Wachi | 84/605 |
| 4,348,929 | 9/1982 | Gallitzendorfer . | |
| 4,433,604 | 2/1984 | Ott | 84/603 |
| 4,466,325 | 8/1984 | Takauji | 84/623 |
| 4,644,400 | 2/1987 | Kouyams et al. . | |
| 4,700,603 | 10/1987 | Takauji et al. | 84/622 |
| 4,905,562 | 3/1990 | Beacham et al. | 84/615 |
| 4,984,496 | 1/1991 | Beacham et al. | 84/604 |
| 5,009,143 | 4/1991 | Knopp | 84/604 |
| 5,086,475 | 2/1992 | Kutaragi et al. | 84/603 |

OTHER PUBLICATIONS

Programs for Digital Signal Processing, IEEE Press, 1979 A. C. Schell, pp. IV, 1.2-1, 8.2, 8.2-2, 8.2-3, 8.2-4.

*Primary Examiner*—William M. Shoop, Jr.
*Assistant Examiner*—Helen Kim
*Attorney, Agent, or Firm*—Baker, Maxham, Jester & Meador

[57] ABSTRACT

A technique for digitally processing a counterpart of a musical sound first transforms a set of time-domain samples of the sound into frequency-domain counterparts and then gradually coerces the frequency-domain counterparts into integer multiples of a fundamental frequency of the sound.

14 Claims, 5 Drawing Sheets

METHOD AND APPARATUS FOR PRODUCING AN ELECTRONIC REPRESENTATION OF A MUSICAL SOUND USING COERCED HARMONICS

This invention concerns the production and storage of electronic counterparts of musical sounds, and particularly relates to a technique for producing such a counterpart by forcing components of a quasi-periodic representation of a musical sound to be integer multiples of a fundamental frequency of the musical sound.

Specifically, the technique presented in this application concerns a frequency-domain technique in which the component frequencies of a digitally-sampled audio signal are gradually changed into integer ratios to the fundamental frequency of the audio signal.

In the music industry, recreation or synthesis of the sound of a traditional acoustic instrument is effected through a process referred to as sampling or pulse-code modulation synthesis. In this process, the sound is represented by an analog waveform. The waveform is time-sampled and the samples are stored in a sequence which is a "counterpart" of the sound. Strictly speaking, a sample is a value that represents the instantaneous amplitude of the subject waveform at a specific point in time. A digital recording of the waveform consists of a sequence of digitally-represented amplitude values sampled at evenly spaced intervals of time. Relatedly, in the music industry, the term "sample" sometimes refers to the sequence of samples which comprise a digital recording. Such a digital recording is not unlike the recording that would be captured with a magnetic tape recorder, except that it could be stored in digital memory and, therefore, can be randomly accessed for synthesis of the recorded sound.

The synthesizer that plays back the digitally-recorded sound is not necessarily the device which recorded the sound in the first place. Presently, few instruments have both record and play capabilities. Most of the musical instruments that employ sampling as a synthesis method use recordings that have been professionally processed, having undergone considerable reshaping before being provided in any electronic musical instrument. Some of the reshaping is done to enhance and clean the recorded sound, but the principal reason for processing the sound is to reduce the amount of memory space required for its storage.

In the description which follows, the terms "recording" and "storage" may be used synonymously. In this regard, the "recording" of a sound for playback may also mean the "storage" of a digital counterpart of the sound in a storage device, where the counterpart consists of a sequence of digital samples.

To reduce the length of recording, or the amount of storage, required for musical sound, the most common form of processing used with sampling is looping, or one of its well-known variations. In looping, a synthesizer plays an original recording of the musical sound up to a designated time point, whereafter it repeatedly plays a short sequence of samples that describe one or more periods of the temporally-varying waveform; this sequence is called a "loop". Because the spectrum of the recorded waveform is temporally varying, it is usually difficult to match the end of a loop with its beginning without creating an audible "click" or "pop" at the point where the end and beginning are spliced together The process is an empirical one requiring a great deal of time and a fair amount of fortune. This is especially true if several different loops are to be used during the life of a re-synthesized note.

In an effort to make looping easier and to attenuate or eliminate the click at the splice point, many synthesizers employ a method known as cross-fade looping. In this technique, the sound at the end of the loop is gradually blended in with the beginning of the loop, thus eliminating the click. This is done by continuously attenuating the amplitude of the end of the loop while raising the amplitude at the beginning of the loop, essentially "fading out" the loop tail while "fading in" the head of the loop. The fade out/fade in gives rise to the name "cross fading". However, the end and the beginning of the loop are still discontinuous although the change from the tail to the head of the loop is less abrupt. Nevertheless, the change in spectrum from the beginning to the end of the loop, both in the amplitude and phase relationships of the component frequencies is pronounced and results in an audible distortion at the cross-over point.

If musical sound could be represented with periodic waveforms, a very efficient loop could be constructed for the electronic representation of the musical sound. In this respect, a periodic waveform is one whose component frequencies have integer ratios with the waveform's fundamental frequency and thus are true harmonics of that frequency. A loop for a periodic waveform requires only the storage and continual cycling of a sequence of samples representing a single period of the waveform. Generation of a musical sound from such a loop will evidence no click and no audible transition because phase, frequency, and amplitude components exhibit spectral continuities between the beginning and the end of the loop. However, very few musical sounds are truly periodic. The only sounds that can be successfully looped are those that are nearly periodic or at least quasi-periodic; that is, sounds in which each period of the time-variant waveform is similar to its predecessor. Quasi-periodicity excludes most percussive sounds, but includes sounds with nearly periodic portions such as those produced by brass instruments, reeds and bowed strings. Pianos and orchestral bells also produce quasi-periodic sounds.

The design of an electronic device to synthesize a sound produced by a musical instrument is greatly aided if the sound is nearly periodic or quasi-periodic. In this regard, it is well-known that the Fourier transform can be used to convert a sequence of samples from a time-domain representation to a frequency-domain counterpart, and then convert them back again without any signal degradation. It is also commonly known that the most important identifying cues of recorded sound occur during an initial portion of the sound. For example, a musical sound (a "note") produced by striking the key of a piano includes an initial portion called the "attack" portion during which particular spectral characteristics identify the note. This is especially true of quasi-periodic sounds that quickly decay in amplitude after an initial burst of energy.

In the electronic synthesis of a piano note, the note is recorded, processed, and then stored in an electronic memory. The stored memory is placed in a musical synthesizer and is used to reproduce the note when an associated key is selected. For quasi-periodic and periodic notes with short initial attacks, a great deal of the electronic memory devoted to storage of the note can be eliminated if the loop portion of the stored representation occurs as soon as possible after the attack portion For playback in a synthesizer, an amplitude envelope that approximates the decay of the original recording can then be imposed upon the loop portion of the stored reproduction. As stated above, the difficulty that arises with traditional looping is the mismatch of the frequency, amplitude, and phase components of the stored reproduction as the loop point is traversed.

Therefore, the prior art of musical sound reproduction still suffers from the significant problem of deviation from an acceptable replica of the original sound. In addition, the prior art processing techniques which replicate the original sound in a stored reproduction result in a need for significant amount of semiconductor memory space for storage of the reproduction.

SUMMARY OF THE INVENTION

The primary objective of this invention is to produce a stored electronic counterpart of a musical sound which employs the looping method to reduce the amount of storage required, yet which eliminates the audible distortion produced by the splicing and cross-fade looping techniques.

A significant advantage which accompanies the achievement of the objective is the elimination of processing circuitry required to implement cross-fading in the prior art.

The achievement of this objective and other objectives is embodied in an invention based upon the inventors' critical observation that in a transition between the attack and loop portions of a recorded counterpart of a musical sound, the frequencies of spectral components of the sound can be manipulated and changed to be substantially integral multiples of the fundamental frequency of the musical sound. By the beginning of the loop, all of the spectral components will then be true harmonics of the fundamental frequency. Significantly, a waveform representation of the musical sound in the loop portion will constitute exactly one cycle of a periodic waveform so that the beginning and end of the loop period will match in frequency, amplitude, and phase. The result is the elimination of the distortion which would result if the loop were constructed according to the prior art techniques.

The invention is practiced by defining a short transition portion between the attack and loop portions of a musical sound's waveform. The sequence of samples derived from the waveform are converted from the time to the frequency domain. During the transition portion, the frequency of each spectral component produced by the conversion is gradually manipulated so as to coerce the frequency into an integer ratio to the fundamental frequency by the time that the loop point is reached. From that point, the frequencies and amplitudes remain constant throughout the loop. After manipulation of the frequencies in the transition, the sequence is converted back to the time domain to produce a counterpart of the musical sound which is then stored in a memory device. The memory device then can be employed in an electronic instrument to synthesize the musical sound represented by the time-domain waveform stored in the device.

DESCRIPTION OF THE PREFERRED EMBODIMENTS

In the invention, an audio signal, produced by a source musical instrument, is digitally recorded The digital recording is a sequence of samples in time, with each sample representing the amplitude of the waveform representing the audio signal at a particular point in time. It is known in the prior art to partition the waveform into attack and loop portions and to capture in electronic memory portions of the sequence of samples so that the sequence can be read out of memory, amplified, and audibly played back to re-create the original audio signal.

Figure 1:
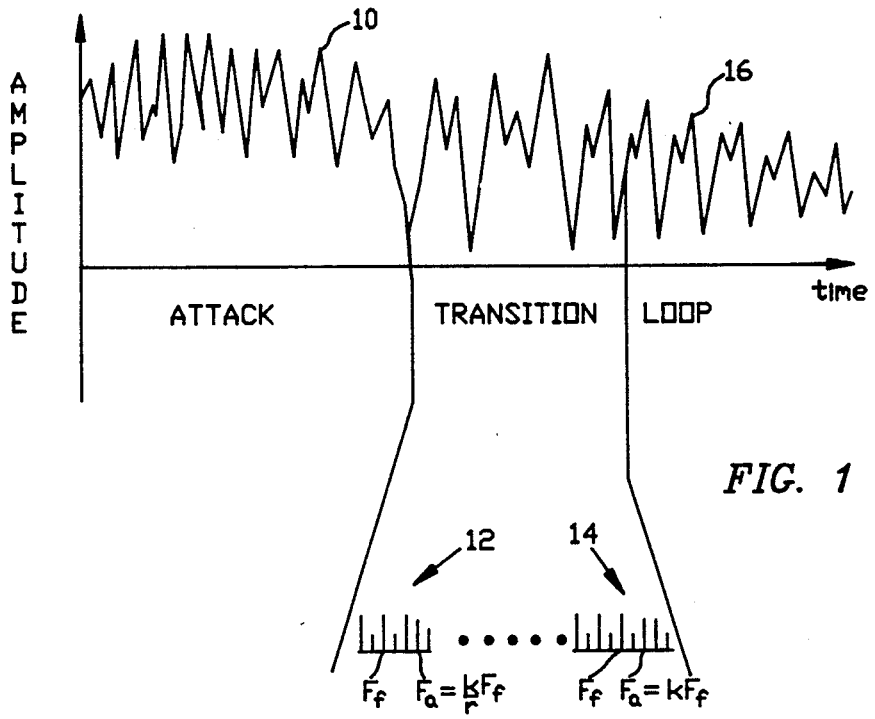
FIG. 1 illustrates a continuous, time-domain representation of a waveform which corresponds to a musical sound produced by a musical instrument and shows a tripartite partition of the waveform according to the invention.

FIG. 1 illustrates the waveform representation of an audio signal 10 and shows the partition of that signal into three portions: attack, transition, and loop. As shown, in the attack portion of the waveform 10, the signal displays wild, aperiodic fluctuations of amplitude. In the transition portion of the waveform, the extremes in the fluctuations of the attack portion have attenuated; however, the waveform still exhibits a marked, though decreasing, non-periodicity. In the loop portion of the waveform, the fluctuations of the attack and transition portions have significantly subsided and the waveform has assumed a somewhat periodic ("quasi-periodic") form. It is asserted that the waveform of FIG. 1 illustrates an audible signal produced by a musical instrument, for example by striking the key of a piano. It is asserted that such a musical sound is characterized in having a "fundamental frequency" such as the sound middle C produced by striking the middle C key on a piano.

According to the invention, the frequencies of the waveform components in the transition portion of the waveform of FIG. 1 are manipulated by a continuous process spanning the transition period so that frequencies which may be rational multiples of fundamental frequency are changed to be integer multiples of the fundamental frequency by the beginning of the loop portion. This is illustrated by the frequency-domain plots 12 and 14.

The frequency-domain plot 12 illustrates the frequency components of the waveform 10 at the beginning of the transition portion At this point, the fundamental frequency of the waveform is denoted by $F_f$, while another frequency component $F_a$ is shown as a multiple of the fundamental frequency. In this regard, frequency component $F_a$ is shown as the product of the rational number k/r (where k and r are integers) and the fundamental frequency $F_f$. By the end of the transition portion, processing according to the invention has changed the frequency component $F_a$ to an integer multiple of the fundamental frequency $F_f$.

The significance of the invention is that with processing of the principal frequency components of the waveform 10 according to the invention, these components will be integer multiples of the fundamental frequency by the beginning of the loop portion. Thus, the frequency components will be true harmonics of the fundamental frequency. Relatedly, and importantly, the waveform 10 can then be represented in the loop portion as a truly periodic waveform. Thus, the portion of the waveform 10 following the attack and transition portions can be represented in electronic storage by a single period of the waveform Furthermore, because the period represents a truly periodic waveform, a constant repetition of the single stored period will present no distortion when transitioning from the end back to the beginning of the loop. Thus, the audible artifacts in the loop portions of prior art synthesized sounds are eliminated.

Figure 2:
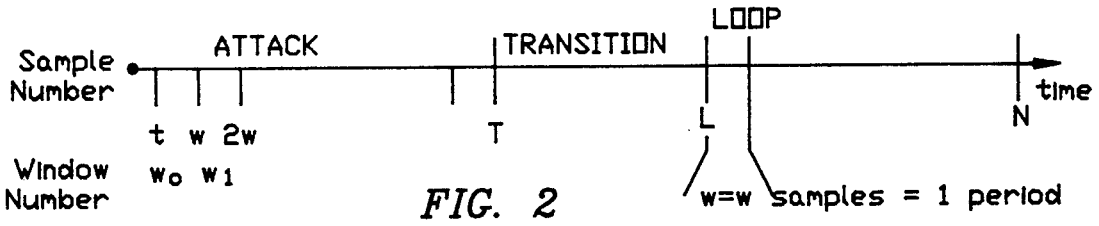
FIG. 2 is a linear mapping of the partitioning of the waveform of FIG. 1 into sets of time-domain samples.

As is known, the waveform of FIG. 1 is captured for electronic storage in the form of a sequence of discrete samples of the amplitude of the waveform taken along the time line in FIG. 1. FIG. 2 represents such storage of the waveform as a sequence of N samples. FIG. 2 is intended to convey how the sequence of the samples is partitioned according to the invention. The illustration shows only sample locations, but does not show the samples themselves. In this regard, the sample sequence extends from sample 1 to sample N. The attack portion of the sequence includes the first T samples, with the Tth sample being the first sample in the transition portion. Sample L is the first sample in the loop portion of the waveform. According to the invention, the sequence of samples in FIG. 2 is further partitioned into a sequence of sample sets, each sample set containing exactly W samples. These sets are termed "windows" and each window has a window number. For example, the first W samples (that is, samples 1 through W) form window $w_0$.

Partitioning the sequence of samples in FIG. 2 into "windows" is a result of conversion of the time-domain representation of the waveform to a frequency-domain one. As explained below, this conversion employs a digital Fourier transform. One important relationship in this process is given by equation (1), in which:

$$F_f = \frac{\text{sampling rate}}{\text{window size}} \quad (1)$$

In equation (1), the window size in samples can be converted to the time duration of a single period of the fundamental frequency by inverting both sides of the equation. This is significant because the W samples contained in any window therefore represent a period of the fundamental frequency. Therefore, the W samples in the Lth window are all that are needed to store a representation of a single period of the fundamental frequency.

Figure 3:
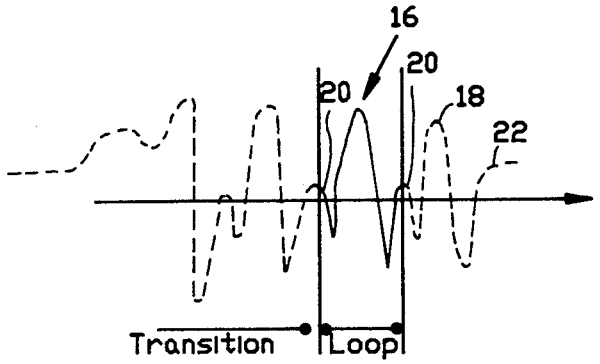
FIG. 3 illustrates how the practice of the invention aligns the frequency, amplitude, and phases of the spectral components of the waveform of FIG. 1 to produce a loop period of the waveform of FIG. 1 according to the invention.

The significance of the invention is illustrated in FIG. 3. FIG. 3 is a magnified representation of the first cycle 16 of the waveform 10 following the beginning of the loop portion. Following is a second cycle 18 shown in dotted outline. Looping occurs when the representation of the cycle 16 held in electronic storage is played from point 20 to point 21. Instead of storing representations of cycle 18 and following cycles, the electronic representation of the cycle 16 between points 20 and 21 is continuously repeated ("looped"). Referring again to FIG. 2, a total of W samples is sufficient to store a representation of the loop representing the cycle 16 which can be continuously cycled.

Figure 4:
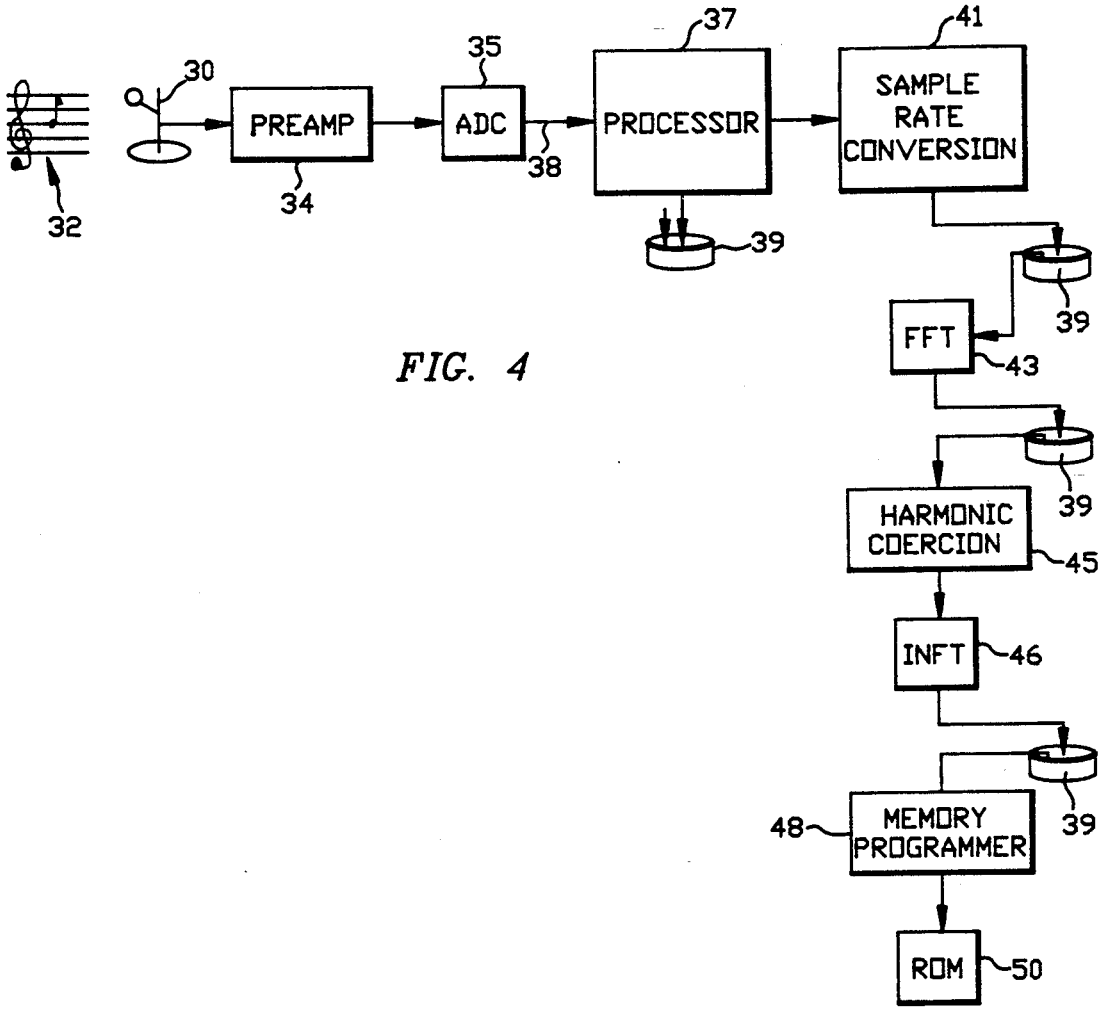
FIG. 4 is a block diagram illustrating a system for producing a stored electronic counterpart of the musical sound according to the invention.

In order to understand the invention, reference is given to FIG. 4 wherein a system for practicing the invention is illustrated.

THE SYSTEM OF THE INVENTION

In FIG. 4, the system for practicing the invention is illustrated and includes a conventional pick-up microphone 30 which is positioned to receive a musical note played, for example, by a piano. The note is represented by the quarter note in the "G" position of the scale fragment 32. As is known, the corresponding key on a piano produces a musical tone having a given fundamental frequency which can be determined by conventional means. The musical tone picked up by the microphone 30 is amplified in an audio passband amplifier 34 and converted from analog to digital form by an analog-to-digital converter (ADC) 35. Preferably, the ADC 35 comprises any conventional converter capable of converting an analog waveform to a sequence of digital samples at a sampling rate sufficient to capture the highest audible harmonic of the musical tone being sampled. For this purpose, the inventors employ an ADC denoted by part number CSZ 5116, available from Crystal Corporation.

As is conventional, the ADC 35 changes the instantaneous amplitude of a waveform produced by the preamp 34 into a digital "word" having a value which represents the instantaneous amplitude. The sequence of digital words output by the ADC 35 forms a sequence of samples representing the musical sound being recorded.

A conventional processor 37 receives at its serial port 38 the sequence of digital words produced by the ADC 35. These words occur at the rate corresponding to the sampling rate. The processor 37, preferably a personal computer of the 386 type, includes a disc storage assembly serviced by a conventional SCSI interface for storing the sample sequence produced by the ADC 35 on a conventional hard disc 39. The processor 37 also includes a CPU which is conventionally programmable to selectively execute application programs in response to prompts, inputs, and commands from a user.

The system blocks 41, 43, 45, and 46 which follow the processor block 37 in FIG. 4 all represent programmed functions which are executed by the processor 37. These functions operate on the sequence of time-domain samples stored on the disc 39, and produce outputs which are, in turn, stored on the disc.

The system blocks 41, 43, and 46 comprise known processing programs which are generally available. The harmonic coercion element 45 has been invented in order to realize the objectives and advantages stated above.

Initially, the sequence of time-domain samples is subjected to a sample rate conversion process 41. Sample rate conversion is a well-known technique which can adjust or convert the sampling rate of a data sequence by a ratio of arbitrary positive integers. In this regard, see the article entitled "A General Program to Perform Sample Rate Conversion of Data by Rational Ratios" by R. E. Crochiere in the work entitled PROGRAMS FOR DIGITAL SIGNAL PROCESSING, edited by the Digital Signal Processing Committee of the IEEE Acoustics, Speech, and Signal Processing Society, and published by the IEEE Press in 1979. The sample rate conversion function 41 is invoked to operate on the time-domain samples stored on the disc 39. The purpose of the conversion function 41 is to adjust the number of samples in order to change the sampling rate for a purpose described below. The output of the sample rate conversion 41 is placed on the disk 39, via the disc storage assembly of the processor 37. The output of the conversion 41 is again a sequence of time-domain samples which define the waveform represented by the original, unconverted sample sequence.

The sample sequence output by the conversion function 41 is next subjected to a conventional, digital fast Fourier transform, represented by block 43 in FIG. 4. Preferably, the fast Fourier transform (FFT) function 43 includes a mixed-radix FFT of the type described in the article by Singleton entitled "Mixed-Radix Fast Fourier Transforms", in the PROGRAMS FOR DIGITAL SIGNAL PROCESSING work cited above. The output of the FFT function 43 embraces arrays of digitally-represented values which are stored, once again, on the disc 39.

The output of the FFT function 43 is operated on by a component of the invention termed the "harmonic coercion" function 45 which adjusts the frequencies of the spectral components of the sample musical tone, which components are produced by the FFT function 43. In the preferred embodiment and best mode of the invention, the results of the harmonic coercion function 45 are provided immediately to the inverse of the Fourier transform embodied in FFT function 43. This inverse transform (INFT) 46 produces a sequence of time-domain samples which are stored on the disc 39.

The output of the INFT function 46 is a sample sequence which corresponds to the attack, transition, and loop portions of the sample sequence of FIG. 2. This sequence is input to a conventional memory programmer 48 which programs the sequence into a memory device such as a read-only memory. For example, the ROM 50 is programmed with the sample sequence stored on the disc 39 by the INFT 46.

In order to understand the harmonic coercion function 45, consider first the sample rate conversion and FFT functions 41 and 43. Initially, the sequence of time-domain samples produced by the ADC 35 is stored on disc 39. The sampling rate of the ADC 35 is high enough to ensure that the highest audible harmonic of the sample waveform is present. (Knowing the fundamental frequency of the waveform, it is possible to either empirically or by analysis determine the highest audible harmonic). With the sample rate and fundamental frequency $F_f$, equation (1) can be employed to determine the window size which, as will be recalled, is equal to the product of the fundamental period of $F_f$ and the sampling rate. The sample rate conversion function 41 is invoked to manipulate the number of samples for the purpose of adjusting the sample rate to a value which will make the window size in number of samples an even integer When the window size is an even integer, operation of the FFT on each window will produce a number of frequency bins which is exactly one-half of the number of samples in a window. Since the sample rate conversion function 41 is employed to make window size an even integer number of samples, the number of frequency bins resulting from the FFT function 43 will be an integer. Those familiar with the operation of an FFT will realize that each bin of the function represents a frequency which is an integer multiple of the fundamental frequency $F_f$.

The performance of the sample rate conversion function 41 is critical to the practice of the invention as it allows the placement of the fundamental frequency $F_f$ in exactly one frequency bin following application of the FFT function 43. Furthermore, if the most noticeable (highest amplitude) harmonic is harmonic number M, exactly M periods of that harmonic will fill one window. Finally, harmonic number M and every other component frequency of the waveform that is harmonic with the fundamental frequency $F_f$ will also fall in exactly one frequency bin of the FFT function 43.

With reference to Tables I and II, the harmonic coercion function 45 will now be explained. In Table I, a plurality of arrays are defined Array I(n) represents the sample sequence stored on the disc 39 after sample rate conversion, and just prior to application of FFT function 43. The product of the INFT function 46 is an output sequence 0(n) of time-domain samples. The FFT function 43 conventionally outputs real and imaginary components, RE and IM, which are indexed by sample sequence window and harmonic number Thus, for each successive window in the input sequence I(n), the FFT function 43 will output M pairs of real and imaginary components. The phase components operated on by the harmonic coercion function are denoted by IP and include M components for each window of the input sequence Output phase components are denoted by the array OP. A total of M amplitude and frequency components are produced by conversion of the real and imaginary components output by the FFT. The frequency components F are operated on by the harmonic coercion function 45. Thus, for each window $w_i$ of the input sequence, exactly M frequency components will be produced, each having an associated amplitude component A.

The arrays defined above are indexed and boundaried by the values given in Table I. In this regard, N is the length of an input or output sequence in number of samples. For example, referring back to FIG. 2, the illustrated sequence has N amplitude samples, numbered from 1 through N. In the invention, sample number T specifies the start of the transition portion of the sequence, while sample L denotes the start of the loop sequence. The sample numbers N, T, and L are nonspecific in FIG. 2. For each musical sound subjected to the invention, the values for these parameters are either known or are determined experimentally prior to the operation of the invention; when determined, they are entered into the processor 37. For each fundamental frequency $F_f$ the number W of samples in one analysis window will vary from one recording to another. Since the sample rate conversion function 41 results in a window size W that is an even integer, the parameter M (the number of significant harmonics yielded by the FFT function 43) will be an integer equal to W/2.

Generally, the FFT function 43 yields the real and imaginary arrays for each analysis window As those skilled in the art will appreciate, the FFT function 43 shifts the sample sequence from the time to the frequency domain. The inverse function of the FFT conventionally transforms the real and imaginary frequency-domain arrays into the output time-domain sequence O.

Table II is a pseudocode representation of the harmonic coercion function It provides the basis for writing an application program in any language supported by the processor 37. In Table II, it is assumed that the input sequence I(N) has been sample-rate-converted as described above so that it consists of N samples over which N/W consecutive windows are defined, where each window spans W samples. The output of the FFT function 43 is the array of real and imaginary value RE(N/W,M) and IM(N/W,M), respectively. These arrays are stored on the disc 39.

The harmonic coercion function 45 converts the real and imaginary arrays to amplitude and frequency values. This is done in step 2 of the process of Table II. First, an input phase array IP(w,m) is calculated, a phase difference is calculated and normalized, and frequency and amplitude components are thereafter derived for each window according to the equations in step 2. In this step, the sampling rate is the rate resulting from the sample rate conversion function 41. Utilization of the phase difference value in the frequency calculation of step 2 preserves the phase information inherent in the sampled waveform.

Recalling that the attack portion of the input sequence extends from window 0 to window (T/W)−1, step 3 of the Table II procedure uses the input amplitude and frequency values for these windows to calculate the real and imaginary components of the attack portion. These are converted by the inverse FT function 46 back into time-domain values. Thus, the attack portion of the sampled waveform is unchanged from its original form. It is observed that the output phase array OP used in the calculation of the real and imaginary component arrays for the attack portion is initialized for W=0 by setting OP(w−1, m) equal to IP(0, m).

Figure 5:
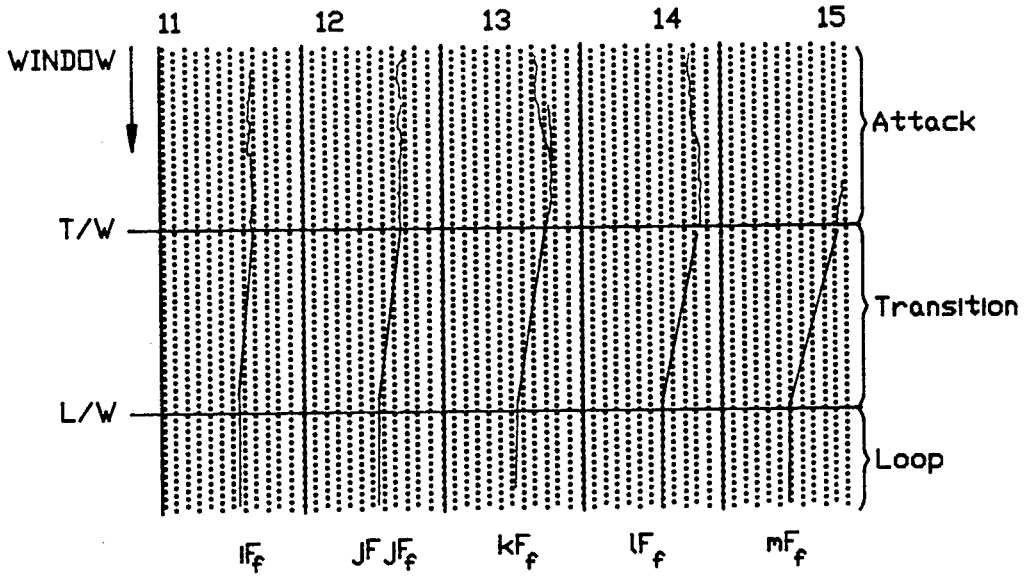
FIG. 5 is a frequency-domain plot illustrating how spectral components of the waveform of FIG. 1 are manipulated according to the invention.

The crux of the invention lies in steps 4 and 5 of Table II. In step 4, the frequencies F which are produced according to conversion step 2 of Table II are changed, window-by-window to be harmonics of (that is, integer multiples of) the fundamental frequency $F_f$. This is accomplished, for each frequency, by straight linear interpolation from the frequency value which the frequency has at the beginning of the transition portion to the center value of its associated bin by the end of the transition portion. This is illustrated in FIG. 5 where bins 11, 12, 13, 14, and 15 of the FFT function 43 are illustrated. As is conventional with an FFT, "bins" are utilized to separate the frequency components produced by conversion of the real and imaginary outputs of the FFT. In actuality, each bin represents a range of frequencies centered on a "bin frequency". The widths of the bins are equal, and the number of bins is determined by the window size as explained above. This is illustrated in FIG. 5 which is separated horizontally into bins, each bin having a respective harmonic number corresponding to one of the M frequencies yielded by the FFT function. In FIG. 5, the vertical dimension corresponds to window numbers so that for each window, conversion of the real and imaginary outputs yields M frequency values. During the attack portion, these frequency values exhibit variance from the center frequencies of their respective bins. Such variance can be considerable as illustrated, for example, by the spread of frequency values in the attack portion of the fifteenth frequency bin.

In the transition portion of FIG. 5, it will be appreciated that a continuous straight line adjustment is made in each frequency bin from the last frequency value in the bin for the attack portion to the center frequency value precisely at the boundary between the transition and loop portions. Since each center frequency is exactly an integer multiple of the fundamental frequency, the bin frequencies are true harmonics of the fundamental frequency. For example, the center frequency of the eleventh bin is equal to i $F_f$, where $F_f$ is the fundamental frequency and i is an integer.

Referring now to step 4 of Table II, the processing performed by the harmonic coercion function 45 on the transition portion of the input sequence is described. First the length of the transition portion in windows is calculated, the value being equated with the parameter T_LENGTH. Now, for each window in the transition portion that is window T/W, which abuts the boundary between the attack and the transition portions, through window (L/W)−1 which abuts the boundary between the transition and loop portions, the frequency value is adjusted by the slope value (position) obtained by dividing the length of the transition portion into the difference in windows between the current window and the first window of the transition period, that is window T/W. The position value is used to adjust the value of the frequency for the current window according to the equation for F(w,m) given in step 4. Once the array of frequency values for each window in the transition portion has been adjusted to force each frequency to a value which is an integer multiple of the fundamental frequency, the real and imaginary components for the transition portion are recalculated using the adjusted values in the frequency array. It is observed that the amplitude values in the attack and transition portions are unaffected, the sole objective being to force the component frequencies to be harmonics of the fundamental frequency. Using the adjusted real and imaginary values, step 4 ends by subjecting the values to the inverse frequency transform and appending the derived sample values at the end of the output array.

In step 5 of Table II, frequency values are not obtained from the array F(w,m). Instead, the frequency values obtaining at the end of the transition portion are utilized. For each bin frequency, this value is obtained by multiplying the bin number m by the sampling rate and dividing the product by the window size W. Step 5 ensures that the phase transition for each frequency from the transition to the loop portion is continuous by picking up the output phase array OP where ended in the transition portion. Then, the real and imaginary components for the single loop window L/W are calculated and subjected to the inverse transform to produce W time-domain samples which are appended to the output array.

Figure 6:
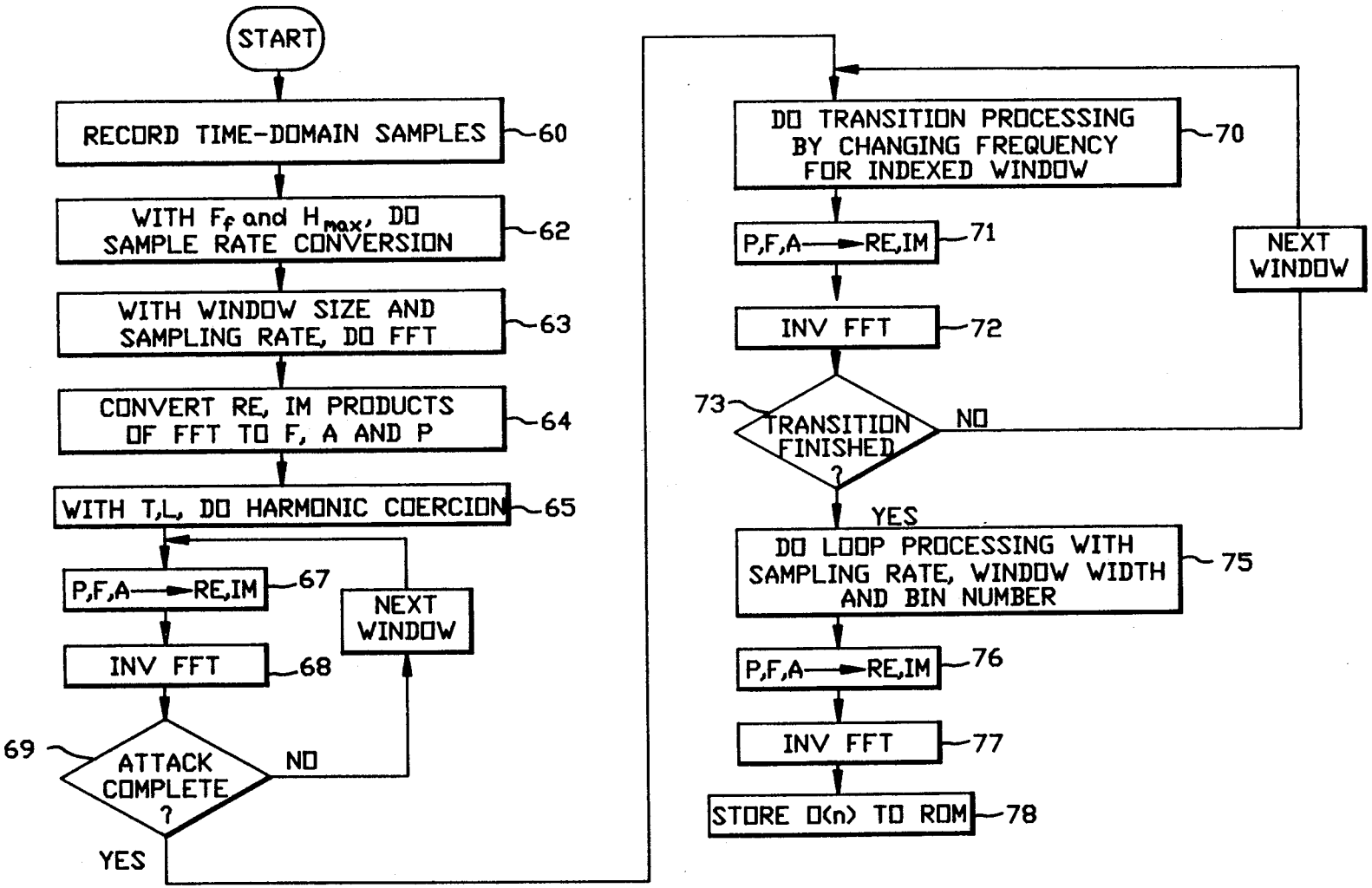
FIG. 6 is a process flow diagram illustrating the method embodied in the system of FIG. 4.

The operation of the method of the invention is illustrated in a flow diagram in FIG. 6. All operations are performed by the processor 37 of FIG. 4 under control of an operator.

In FIG. 6, the method of the invention includes recording the sequence of time-domain waveform samples prior to sample rate conversion. This is step 60. Next, in step 62, knowing the fundamental frequency $F_f$ and the highest audible harmonic ($H_{max}$), sample rate conversion is performed in order to make the window size an even integer while keeping the converted sample rate high enough to capture $H_{max}$. In step 63, having adjusted the sampling rate to achieve the desired window size, the time-domain sequence is converted to frequency-domain arrays of real and imaginary values by the FFT.

Next, in step 64, the real and imaginary products of the FFT are converted to frequency (F), amplitude (A), and phase (P) arrays in accordance with step 2 of Table II. Next, in step 65, the transition and loop portions are defined by identification of sample T and sample L. Preferably, these values are input by operator action via the processor 37. With these inputs, the harmonic coercion function 45 is invoked.

In accordance with step 3 of Table II, the attack portion of the waveform is converted back into an output sequence of time-domain samples O(n) in steps 67, 68, and 69. Step 69 indexes on the window numbers in the attack portion, which extends from window $w_0$ to window $w_{(T/W)-1}$. For each window, the real and imaginary components for each of the M frequencies are calculated in step 67 and combined by the inverse FFT in step 68 to yield time-domain values which form the attack portion of the output array O(n). When the time-domain values have been recalculated for the attack portion, the positive exit is taken from decision 69 and transition processing is begun in step 70.

Steps 70, 71, 72, and 73 perform transition processing, indexing on each window of the transition portion and, during each window, on each of the M component frequencies. Thus, for each transition window, step 70, by linear interpolation, changes each component frequency from its value at the beginning of the transition to a new value for the indexed window. Of course, when the indexed window is the last one in the transition, that is window $w_{(L/W)-1}$, each frequency value will be almost an integer multiple of the fundamental frequency. In steps 71 and 72, the phase, frequency, and amplitude values for the window are converted to real and imaginary values and then to time-domain values. The set of time-domain samples for the indexed window are then appended to the output array O(n). When the time-domain samples for the last window of the transition portion have been appended to the output array, the positive exit is followed from decision 73 and loop processing is executed.

In loop processing corresponding to step 5 of Table II, all of the component frequencies available for inverse Fourier processing are now harmonic with the fundamental frequency. Thus, preparation of a window-wide set of time-domain samples can be accomplished by steps 75–77. In step 75, the sampling rate, window width, and FFT bin number are used for each component frequency to obtain the frequency's value. Using the set of frequencies calculated in step 75 for the window, step 76 calculates the real and imaginary components for the frequencies from the phase, frequency, and amplitude arrays for the window. The inverse FFT is invoked in step 76 to produce the time-domain samples, which are appended to the output array On..

In step 78, the output array is transferred from the disc 39 to a permanent memory such as a ROM.

Figure 7:
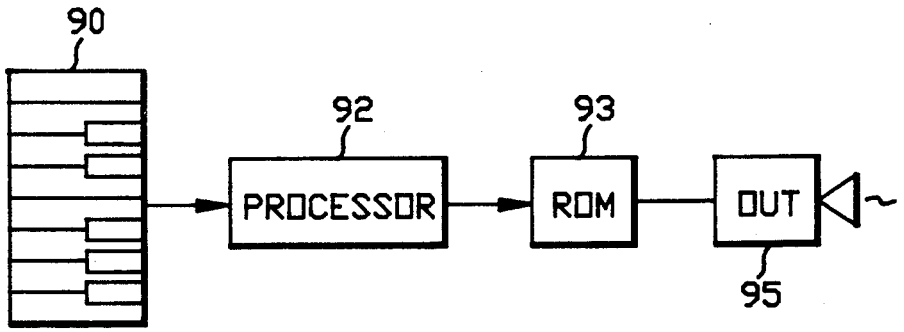
FIG. 7 is a block diagram illustrating an operative environment in which an electronic counterpart of a musical sound produced according to the invention is employed in an electronic instrument.
Figure 8:
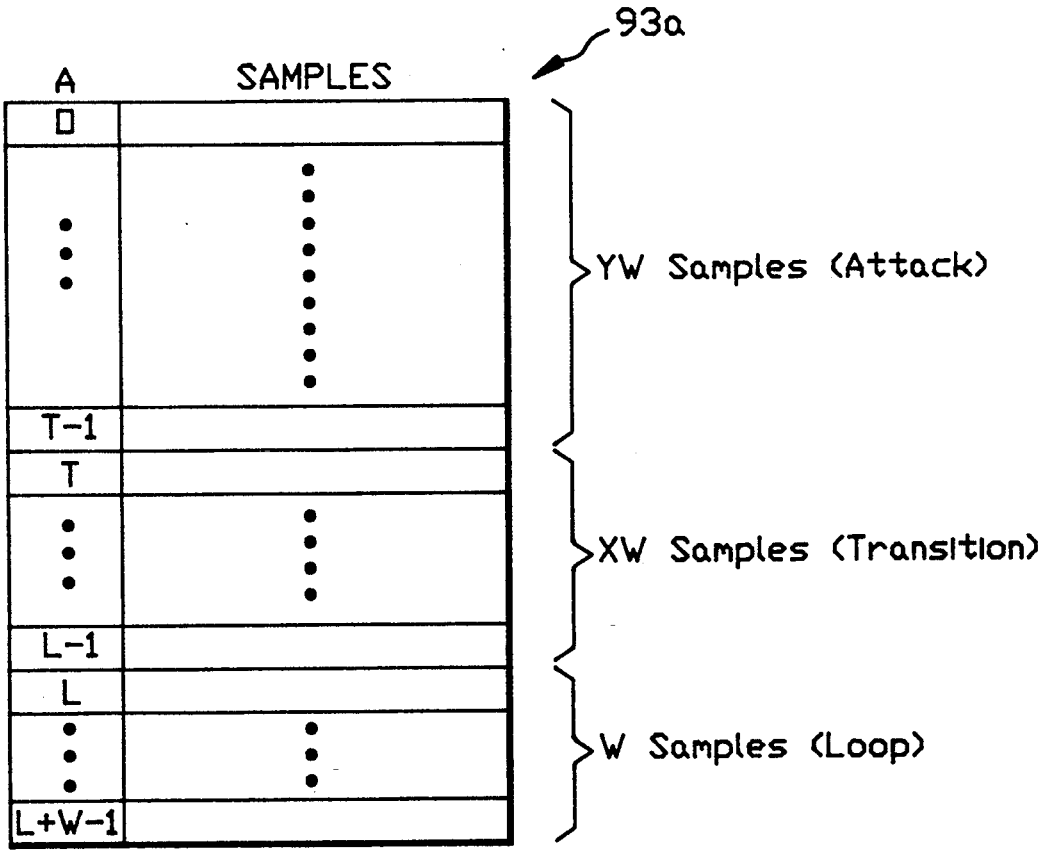
FIG. 8 is a memory map illustrating how a sequence of time domain samples subjected to the process of the invention are stored in the memory of FIG. 7.
Figure 9:
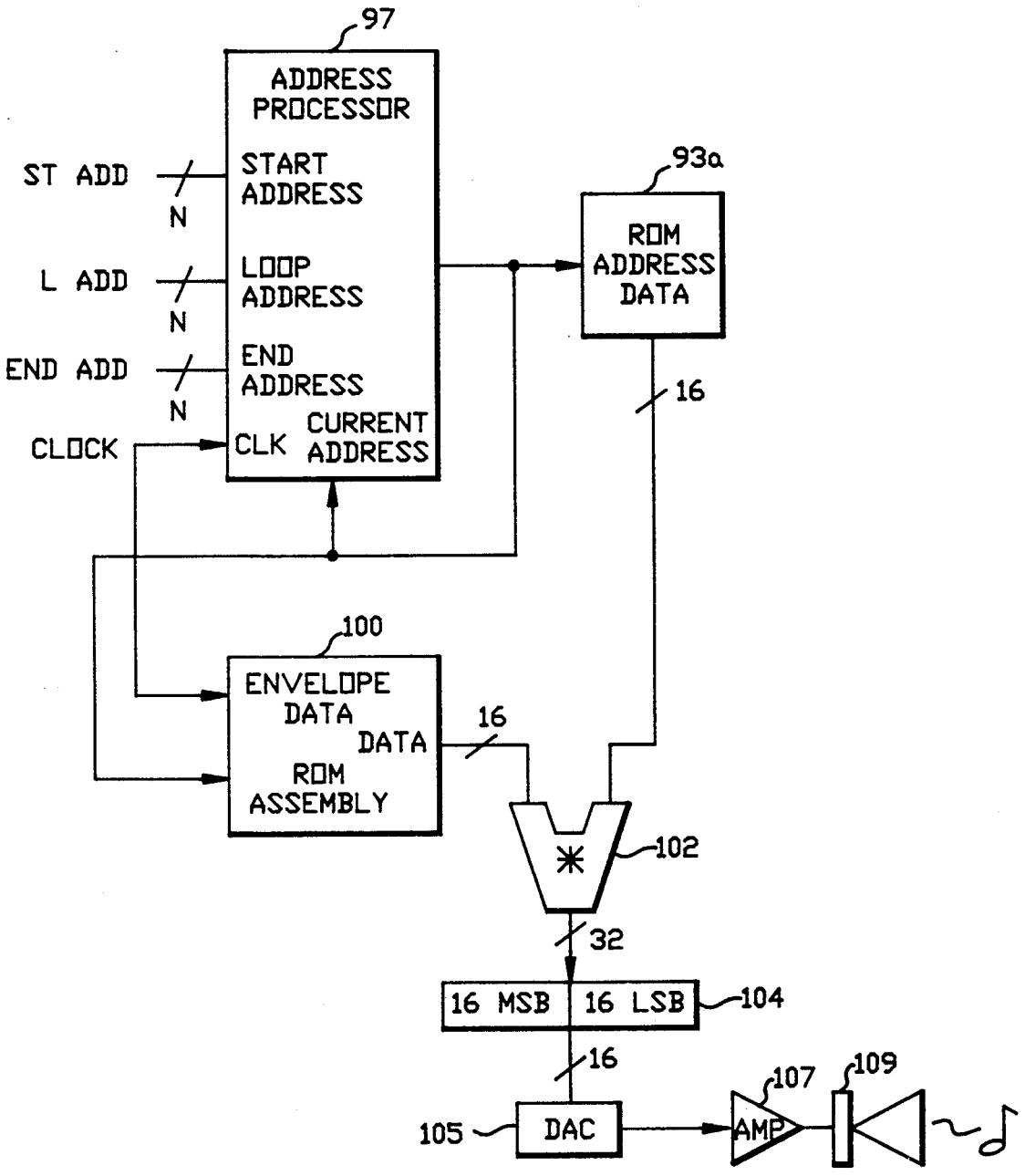
FIG. 9 is a block diagram illustrating in greater detail certain components of the system of FIG. 7.

FIGS. 7–9 illustrate use of an output array comprising a sequence of time-domain samples processed according to the technique laid out above. In FIG. 7, the electronic instrument can include a keyboard 90 connected to a processor 92 which controls a ROM array 93. The keyboard 90 is operated in a conventional manner and includes an interface which converts playing of the keyboard into a set of signals. The signals are received by the processor 92 which, in response, accesses musical tone counterparts stored in the ROM array 93. Each stored sequence corresponds to a respective key of the keyboard. When a key is selected (played), the processor accesses the ROM to read out the corresponding sequence. The musical tone representations are time-domain sample sequences containing attack, transition, and loop sections as described above. When a sequence is read out of the ROM; it is passed to an output apparatus 95. The output apparatus converts the digital time-domain samples read from the ROM array 93 to analog form, amplifies them, and provides them to a speaker which generates an audible output in response.

FIG. 8 represents a memory map for a sequence of time-domain samples which have been processed according to FIG. 6. In particular, FIG. 8 represents a ROM sector in which a sequence like that in FIG. 2 is stored. In this regard, a ROM sector **93*a*** includes storage space to store the sequence of time-domain samples at addressable locations 0 through N−1. The first T samples comprise the attack section and are stored at address locations 0 through T−1. The transition section samples are stored at address locations T through L−1 and include samples which have been harmonically coerced according to the technique described above. Last, the sequence of samples representing the loop section of the overall sequence stored at address location L through L+W−1. In keeping with the description above, the loop section can include as few as W samples which is a sufficient number to represent a single period of the fundamental frequency.

FIG. 9 illustrates in greater detail the elements of FIG. 7 which are necessary to play back the musical sound whose counterpart is stored in the ROM **93*a* of FIG. 8. In this regard, it is asserted that the processor 92 includes a conventional address processor 97 which outputs a sequence of addresses on a connection to the address port of the ROM 93*a*. In response to addresses provided at the address port of ROM 93*a*, the time-domain samples are provided at the data port of the ROM. The data port of the ROM 93*a* is fed to one input of the conventional digital multiplier 102 which receives, at its other input, envelope data from an envelope data assembly 100**.

Assuming that the samples in the ROM **93*a* are represented by 16-bit words, the envelope data will also be in 16-bit form and the multiplier 102 will produce a 32-bit product which is truncated at register 104 to the most significant 16 bits. These 16 bits are fed to a digital-to-analog converter (DAC) 105 which converts the sequence of products into a continuous analog output amplified at 107. The amplified output is fed to a speaker at 109** which generates the musical sound with an appropriate attenuation envelope.

Assume now that the key on the keyboard 90 corresponding to the musical sound stored in the ROM sector **93*a* is selected. In this case, the processor 92 identifies the ROM 93*a* and provides to the address processor 97 a start address, a loop address, and an end address. The processor 92 also provides a clock waveform to the address processor 97. In response to these inputs, the address processor generates a sequence of addresses at the clock rate. The sequence begins at the start address which corresponds to address 0 in FIG. 8** and then generates the sequence of addresses from the start address to the loop address L. Once the address processor reaches the loop address, it enters a loop mode in which it cycles from the loop address, L, to the end address L+W−1. Once the end address is reached, the address processor begins the cycle again from the loop address, and so on.

The amplitude envelope data assembly 100 is operated synchronously with the address processor 97 by provision of the same clock signal. The operation of the envelope data assembly 100 is represented by the process described in Table III. In Table III, the index n corresponds to the address sequence output by the address processor 97. The assembly provides data which is described by the parameters g and r in Table III. In this regard, for so long as the ROM 93*a* is being addressed sequentially through the attack and transition portions of the stored representation, the gain factor provided from the assembly 100 is unity. When the loop portion of the ROM 93*a* is addressed, the gain factor is reduced incrementally each time the loop in the ROM 93*a* is begun. For each traversal of the loop, the gain factor is decremented by the amplitude ramp factor r for so long as the loop is traversed. This will impose a constant attenuation on the amplitude of the musical sound produced at 109.

TABLE I

| Definitions: | |
|---|---|
| Arrays: | |
| I (n) | Input sequence that represents a recorded sound in which one period of the fundamental frequency is exactly W samples. |
| O (n) | Output sequence (the result of the method shown here). |
| RE (w,m) | The real components of the DFT output. |
| IM (w,m) | The imaginary components of the DFT output. |
| IP (w,m) | The original input phase components (used in intermediate calculations). |
| OP (w,m) | The output phase components (also used in intermediate calculations). |
| A (w,m) | Amplitude components. |
| F (w,m) | Frequency components. |
| Array indices and boundaries: | |
| N | The number of samples in (or length of) sequences I and O. |
| n | Sample index. |
| T | The sample number that specifies the start of the transition segment |
| L | The sample number that specifies the start of the loop segment. The sample times N, T, and L are arbitrary, are determined experimentally, and will vary from one recording to another. |
| W | Number of samples in one analysis window, the length of the fundamental period. |
| w | Window number index. |
| M | The number of significant harmonics yielded by the DFT. The quantity M depends on window size W (the size of the fundamental period). |
| m | Harmonic number index. |
| Transforms: | |
| DFT{ } is a discrete Fourier transform that yields two arrays, real RE and imaginary IM, for each analysis window. This provides the shift from the time domain to the frequency domain. The window size is chosen so that an integer number of periods fall within the window. | |
| invDFT{ } is an inverse discrete Fourier transform that transforms the two frequency-domain arrays, real RE and imaginary IM, into the time-domain array O. | |

TABLE II

| Sequence preparation: |
|---|
| 1. Convert the entire time-domain sequence to the frequency domain. |
| for n = 0 to N |
| DFT{I(N)} → RE(N/W,M) and IM(N/W,M) |
| 2. Convert RE(w,m) and IM(w,m) to A(w,m) and F(w,m) |
| for w = 0 to N/W |
| for m = 0 to M |
| IP(w,m) = arctangent {IM(w,m)/RE(w,m)} |
| phase difference = IP(w,m) − IP(w − 1,m) |
| normalize phase.difference to fall in the range −π to π |
| F(w,m,) = sampling rate · (phase.difference/2π + m/W) |
| A(w,m) = square.root{RE(w,m) · RE(w,m) + IM(w,m) · IM(w,m)} |
| 3. Attack portion. Use input amplitudes and frequencies. |
| for w = 0 to (T/W) − 1 |
| for m = 0 to M |
| OP(w,m) = OP(w − 1,m) + (F(w,m) − (n/W)) · 2π/sampling rate |
| normalize OP (w,m) to fall in the range 0 to 2π |
| RE(w,m) = A(w,m) · cos{OP(w,m)} |
| IM(w,m) = A(w,m) · sin{OP(w,m)} |
| invDFT{RE(w,M), IM(w,M)} → O(n) |
| 4. Transition portion. Gradually coerce frequencies to be harmonic. Use input amplitudes. |
| T.LENGTH = 1 + L/W − T/W, the length of the transition (in windows) |
| for w = T/W to (L/W) − 1 |
| position = (w − T/W)/T.LENGTH |
| F(w,m) = (F(T,m) · (1 − position)) + (position · m · sampling rate/W) |
| for m = 0 to M |
| OP(w,m) = OP(w − 1,m) + (F(w,m) − (n/W)) · 2π/sampling rate |
| normalize OP(w,m) to fall in the range 0 to 2π |
| RE(w,m) = A(w,m) · cos{OP(w,m)} |
| IM(w,m) = A(w,m) · sin{OP(w,m)} |
| invDFT{RE(w,M), IM(w,M)} → O(n) |
| 5. Loop portion. Freeze amplitudes and frequencies (now harmonic). |
| w = (L/W) |
| F(w,m) = m · sampling rate/W |
| OP(w,m) = OP(w − 1,m) + (F(w,m) − (n/W)) · 2π/sampling rate |
| normalize OP(w,m) to fall in the range 0 to 2π |
| RE(w,m) = A(w,m) · cos{OP(w,m)} |
| IM(w,m) = A(w,m) · sin{OP(w,m)} |
| invDFT{RE(w,M), IM(w,M)} → O(n) |

TABLE III

| Playback of sequence (simplified): | |
|---|---|
| g | gain factor |
| r | amplitude ramp factor = 1/(decay time in seconds · sampling rate) |
| DAC | digital to analog converter |
| for n = 0 to L − 1 | |
| O(n) → DAC | |
| g = 1 | |
| while g > 0 | |
| for n = L to N − 1 | |
| g · O(n) → DAC | |
| g = g − r | |

While we have described several preferred embodiments of our invention, it should be understood that modifications and adaptations thereof will occur to persons skilled in the art. For example, the best mode and preferred embodiment of the invention include using the phase component in the harmonic coercion function. However, the inventors contemplate an embodiment that does not incorporate or utilize the phase component in harmonic coercion. Therefore, the protection afforded my invention should only be limited in accordance with the scope of the following claims.

We claim:

1. A method of creating and preserving a counterpart of a sound having a fundamental frequency, the method utilizing an addressable memory and comprising the steps of:

generating a sequence of original time-domain samples of the sound, the sequence including successive adjacent portions in which a first portion exhibits aperiodic fluctuations of amplitude of the sound, a second portion, following the first portion, exhibits decreasing aperiodic fluctuations of amplitude of the sound, and a third portion, following the second portion, exhibits substantially periodic fluctuations of amplitude of the sound;

transforming the sequence of original time domain samples to frequency domain values including a set of frequency values representing component frequencies of the sound, the frequency values including the fundamental frequency and a plurality of related frequencies;

from the beginning of the second portion, changing related frequencies in the set of frequency values such that the related frequencies are substantially integral multiples of the fundamental frequency by the end of the second portion;

transforming the frequency domain values to a sequence of adjusted time domain values; and p1 storing the sequence of adjusted time domain values in a memory device.

2. A method for synthesizing sound made by a musical instrument, comprising the steps of:

generating a plurality of amplitude samples of the sound;

partitioning the plurality of samples into successive, adjacent attack, transition, and loop portions, wherein:

in the attack portion, the amplitude samples display aperiodic fluctuations of the amplitude of the sound;

in the transition portion, the amplitude samples display decreasing aperiodic fluctuations of the amplitude of the sound; and in the loop portion, the amplitude samples display substantially periodic fluctuations of the amplitude of the sound;

transforming the samples of the transition portion into frequency and amplitude components of the sound, the frequency components including a fundamental frequency component and a plurality of related frequency components;

from the end of the attack portion until the beginning of the loop portion, substantially continuously adjusting the value of each of said related frequency components over the length of the transition portion such that each of said related frequency components has substantially an integer ratio to the fundamental frequency; and transforming the frequency and amplitude components of the transition portion back to transition amplitude samples.

3. The method of claim 2, further including:

transforming the samples of the loop portion into frequency and amplitude components of the sound, the frequency components including the fundamental frequency component and the related frequency components;

changing the value of each of said related frequency components to an integer multiple of the fundamental frequency; and transforming the altered frequency and amplitude components of the loop portion back to loop amplitude samples.

4. The method of claim 2, wherein the step of generating a plurality of amplitude samples includes:

generating a sequence of time-domain samples of the musical sound at a first sampling rate;

converting the first sampling rate to a second sampling rate according to:

$$Ff = \frac{\text{second sampling rate}}{W}$$

where W represents a transfer window having W samples and W is an even integer;

for each consecutive group of W time-domain samples, transforming the samples into real and imaginary components; and transforming the real and imaginary components into frequency and amplitude components.

5. The method of claim 2, including:

transforming the samples of the attack portion into frequency and amplitude components; and, wherein the step of substantially continuously adjusting including preserving phase continuity between the frequency components of the attack portion and the frequency components of the transition portion.

6. The method of claim 5, further including, for the loop portion, generating frequency and amplitude components of the sound for at least one period of the fundamental frequency, the frequency components including the fundamental frequency and the related frequency components, each of the related frequency components having substantially an integer ratio to the fundamental frequency, the frequency components of the loop portion having phase continuity with the frequency components of the transition portion.

7. The method of claim 2, including:

transforming the samples of the attack portion into frequency components, the frequency components including a fundamental frequency component and a plurality of related frequency components, each related frequency component having a value at the end of the attack portion; and, wherein the step of substantially continuously adjusting including, for each related frequency, interpolating values of the related frequency between a value for the related frequency at the end of the attack portion and an integer multiple of the fundamental frequency at the end of the transition portion.

8. In an apparatus for synthesizing musical notes in response to selection of keys on a keyboard, a combination comprising:

key conversion means for generating a sequence of address signals which corresponds to a selected key;

storage means connected to the key conversion means and containing stored amplitude signals at addressable storage locations for providing a sequence of amplitude signals representing a musical note corresponding to the selected key in response to the sequence of address signals, wherein:

the sequence of amplitude signals representing the amplitude of the musical note and including a first portion in which the amplitude of the musical note exhibits aperiodic fluctuations, a second portion wherein the amplitude of the musical note exhibits decreasing aperiodic fluctuations, and a third portion in which the amplitude of the musical note exhibits substantially periodic fluctuations;

the sequence of amplitude signals including a set of frequency components with a fundamental frequency and a plurality of related frequencies, wherein the the related frequencies in the second portion of the sequence of amplitude signals interpolate from first values to integral multiples of the fundamental frequency; and output means connected to the storage means for producing an analog counterpart of the musical note in response to the sequence of amplitude signals.

9. An apparatus for transforming musical signals, comprising:

conversion means for converting a musical sound into a sequence of amplitude samples representing change in amplitude of the musical sound over time;

transform means connected to the conversion means for transforming successive, adjacent portions of the sequence of amplitude samples into frequency and amplitude components of the musical sound, the frequency components including a fundamental frequency and a plurality of related frequencies, the successive, adjacent portions including an attack portion in which the amplitude of the musical sound has aperiodic variations, a transition portion following the attack portion in which the amplitude of the musical note has decreasing aperiodic variations, and a loop portion following the transition portion in which the amplitude of the musical note has substantially periodic variations;

means in the transforming means for substantially continuously adjusting the value of each of the related frequency components over the transition portion such that each of the related frequency components is a respective integer multiple of the fundamental frequency;

means for transforming the frequency and amplitude components back to a sequence of amplitude samples; and means connected to the second transforming means for storing a plurality of sequences of amplitude samples, each sequence of amplitude samples corresponding to a respective musical sound.

10. The apparatus of claim 9, wherein the means in the transforming means is further for:

changing the value of each of the related frequency components over the loop portion each of the related frequency components to a respective integer multiple of the fundamental frequency.

11. The apparatus of claim 9, wherein the conversion means includes:

means for generating a sequence of time-domain samples of the musical sound at a first sampling rate; and means for converting the first sampling rate to a second sampling rate according to:

$$F_f = \frac{\text{second sampling rate}}{W}$$

where W represents a transfer window having W samples and W is an even integer; and wherein: the transform means is further for:

transforming the samples of each consecutive group into real and imaginary components; and transforming the real and imaginary components into frequency and amplitude components.

12. The apparatus of claim 9, wherein the means in the transforming means is further for preserving phase continuity between the frequency components of the attack portion and the frequency components of the transition portion.

13. The apparatus of claim 9, further including:

means in the transforming means for generating frequency and amplitude components of the sound in the loop portion for at least one period of the fundamental frequency, the frequency components including the fundamental frequency and the related frequency components, each of the related frequency components being substantially an integer ratio to the fundamental frequency, and for preserving phase continuity between the frequency components of the transition portion and the frequency components of the loop portion.

14. The apparatus of claim 9, wherein each frequency of the related frequencies has a value at the end of the attack portion and, wherein the means in the transforming means is for interpolating values for each related frequency between a value for the related frequency at the end of the attack portion and an integer multiple of the fundamental frequency at the end of the transition portion.

* * * * *

UNITED STATES PATENT AND TRADEMARK OFFICE

CERTIFICATE OF CORRECTION

PATENT NO. : 5,196,639

DATED : March 23, 1993

INVENTOR(S) : Lee et al

It is certified that error appears in the above-identified patent and that said Letters Patent is hereby corrected as shown below:

Column 17, line 23, please change "transform" to --first transforming--;
line 37, please insert --first-- between "the" and "transforming"; and
line 44, please insert --second transforming-- immediately preceeding "means".

Column 18, lines 2, 26, 31, and 44, please insert --first-- immediately preceeding "transforming"; and
line 20, please change "transform" to --first transforming--.

Signed and Sealed this

Twenty-eighth Day of December, 1993

*Attest:*

Bruce Lehman

BRUCE LEHMAN

*Attesting Officer*

*Commissioner of Patents and Trademarks*